United States Patent [19]

Lombardi

[11] Patent Number: 4,819,536

[45] Date of Patent: Apr. 11, 1989

[54] DRUM PEDAL MOVEMENT RESPONSIVE DEVICE TO PRODUCE ELECTRICAL SIGNAL

[76] Inventor: Donald G. Lombardi, 2118 E. Hillcrest Dr., Thousand Oaks, Calif. 91360

[21] Appl. No.: 132,892

[22] Filed: Dec. 14, 1987

Related U.S. Application Data

[63] Continuation-in-part of Ser. No. 001,356, Jan. 8, 1987, Pat. No. 4,756,224.

[51] Int. Cl.[4] ..... G10D 13/02; G10H 1/46

[52] U.S. Cl. ..... 84/1.01; 84/1.1; 84/1.15; 84/DIG. 12; 84/422.1

[58] Field of Search ..... 84/1.01, 1.04, 1.06–1.1, 84/1.14, 1.15, 1.24, 1.27, 422 R, 422 S, 422 C, DIG. 7, DIG. 12

[56] References Cited

U.S. PATENT DOCUMENTS

| | | | |
|---|---|---|---|
| 3,797,356 | 3/1974 | Duffy et al. | 84/422 C |
| 4,346,638 | 8/1982 | Hoshino | 84/422 R |
| 4,366,463 | 12/1982 | Barker | 84/DIG. 7 |
| 4,538,499 | 9/1985 | Livingston | 84/422 R |
| 4,562,764 | 1/1986 | Marshall | 84/1.1 |
| 4,691,613 | 9/1987 | Jacobson | 84/422 R |
| 4,732,070 | 3/1988 | Yamashita | 84/1.04 |
| 4,744,279 | 5/1988 | Livingston | 84/1.01 |

*Primary Examiner*—Stanley J. Witkowski
*Attorney, Agent, or Firm*—Willaim W. Haefliger

[57] ABSTRACT

A foot-operated, bass drum pedal assembly is provided, and it includes: a base in the form of a metal plate, a first drum beater, a support for the beater mounted on the base, and a pedal pivotally mounted to the base and operatively connected to the beater to pivot same as the pedal is pivoted by the drummer's foot, and structure located proximate the pedal to sense downward movement of the pedal to predetermined downward position, and to produce an electrical signal usable to effect production of phenomena corresponding to a drum beat.

19 Claims, 4 Drawing Sheets

DRUM PEDAL MOVEMENT RESPONSIVE DEVICE TO PRODUCE ELECTRICAL SIGNAL

BACKGROUND OF THE INVENTION

This application is a continuation-in-part of Ser. No. 001,356, filed Jan. 8, 1987 and now U.S. Pat. No. 4,756,224.

This invention relates generally to improvements in drum beating equipment; more particularly it concerns proximity detection of beater pedal movement in a downward direction, to produce synchronized phenomena, such as acoustic beats, or the like.

It is known to produce an electronic signal to trigger a synthetic drum machine, using a transducer placed on a bass drum to detect the impact and/or the vibration of a pedal beater striking the bass drum head. In order to accurately track the magnitude of the beater's force of impact, the required sensitivity of the electronic signal makes it difficult if not impossible for a drum synthesizer to discriminate between a valid drum hit and spurious signals caused by natural drum after-ring and extraneous vibration.

There is need for more sensitive and accurate apparatus to produce beat sounds in synchronism with beater striking of a drum head.

SUMMARY OF THE INVENTION

Basically, the invention is embodied in a foot-operated, bass drum pedal assembly using a proximity detector associated with the pedal, and in way to timewise very accurately trigger a beat synthesizer.

Using a proximity detector to sense the position of the bass drum pedal provides a reliable trigger source that is physically independent of the bass drum, eliminating all false triggering from external sources and undesirable drum characteristics. The speed of the pedal when operating provides information to a proximity sensor that can be converted into signal that is proportional to the loudness of the note played. The position of the pedal can be used to gate the signal when the beater strikes the drum head. Both magnitude and timing of the resulting output signal can be easily user adjusted to compensate for mechanical dissimilarities between bass drums of different manufacture and electronic variations between different drum synthesizer designs. The use of a proximity detector is applicable to any pedal device used in drum synthesizer applications (e.g. a hi-hat pedal).

As will appear, the invention is embodied in an assembly that includes (a) a base in the form of a metal plate, a first drum beater, a support for the beater mounted on the base, and a pedal pivotally mounted to the base and operatively connected to the beater to pivot same as the pedal is pivoted by the drummer's foot, (b) and means located proximate the pedal to sense downward movement of the pedal to predetermined downward position, and to produce signal usable to effect production of phenomena corresponding to a drum beat.

More specifically, drum pedal velocity is converted into a voltage that is proportional to the speed of the foot pedal. This voltage is gated such that the onset of the voltage is determined by the position of the pedal. A magnet is mounted on the bottom of the foot pedal. A Hall Effect Device (herein called an HED) in a housing with other electronics is mounted on a base plate directly below the magnet. When the pedal is in its up or rest position the magnet's field has the least effect on the HED. As the pedal moves toward the HED, the HED's output increases proportional to the proximity of the magnet. The HED's output is sent to circuitry that produces a synthesized beat.

In one unusually advantageous example, the HED output is passed to a differentiator circuit whose output voltage is proportional to the time derivative of the rate of change of the HED voltage. The faster the pedal travels, the higher the output of the differentiator circuit. The differentiator's output is then sent to a Field Effect Transistor gate. The HED's output is also sent to a comparator circuit with hysteresis added which toggles when the output of the HED reaches a certain level. The threshold of the comparator is set to coincide with the pedal beater striking the drum head. The output of the comparator turns the gate on and off. The "on" signal to the gate has a pulse width of two to five milliseconds. [A velocity sensitive pedal circuit can be used using light, radio waves, electromagnetic interference, ultra sonic sound pulses, etc., in place of magnetism.] The transister "on" output triggers a drum sound synthesizer to cause a speaker to produce the synthetic beat sound.

In addition, the invention may be embodied in an assembly that includes (a) a bottom, horizontally extending support plate, (b) two upright members attached to and supported by the plate, (c) a horizontal axle supported by the members for rotation about a horizontal axis, (d) a sprocket carried by the axle at a support location, the sprocket having peripheral chain engaging teeth, and a chain meshing with said teeth, an end portion of the chain anchored to the sprocket, the chain having a dangling portion extending below the sprocket, (e) the chain having a mid-portion meshing with said teeth and being at increasing distance from said axis along the chain length in a direction toward said dangling portion, (f) a pedal having a rear portion hingedly supported by the plate and a front portion attached to said dangling portion of the chain, and (g) the drum beater attached to the axle, to be rotated thereby, the beater operated in synchronism with the beat synthesizing means associated with the pedal and referred to above.

As will appear, the speed of reaction of the beater in response to pedal movement is thereby enhanced for more accurately timed drum beating; and pedal return to up-position is accelerated, to more quickly position the pedal for a subsequent down push, for the next drum beat.

A clamp finger may be carried by a yoke, attached to the support plate and is attachable to a bass drum rim that overhangs the forwardmost extent of the base plate; and the clamp finger is typically rotatably carried by the yoke, the yoke having two forwardly extending tongues beneath the level of the clamp finger, and supported by the base plate forwardmost extent, the tongues adapted to support the lower side of the bass drum rim, the upper side of which is clamped by the finger.

These and other objects and advantages of the invention, as well as the details of an illustrative embodiment will be more fully understood from the following specification and drawings, in which:

DRAWING DESCRIPTION

DETAILED DESCRIPTION

Figure 1:
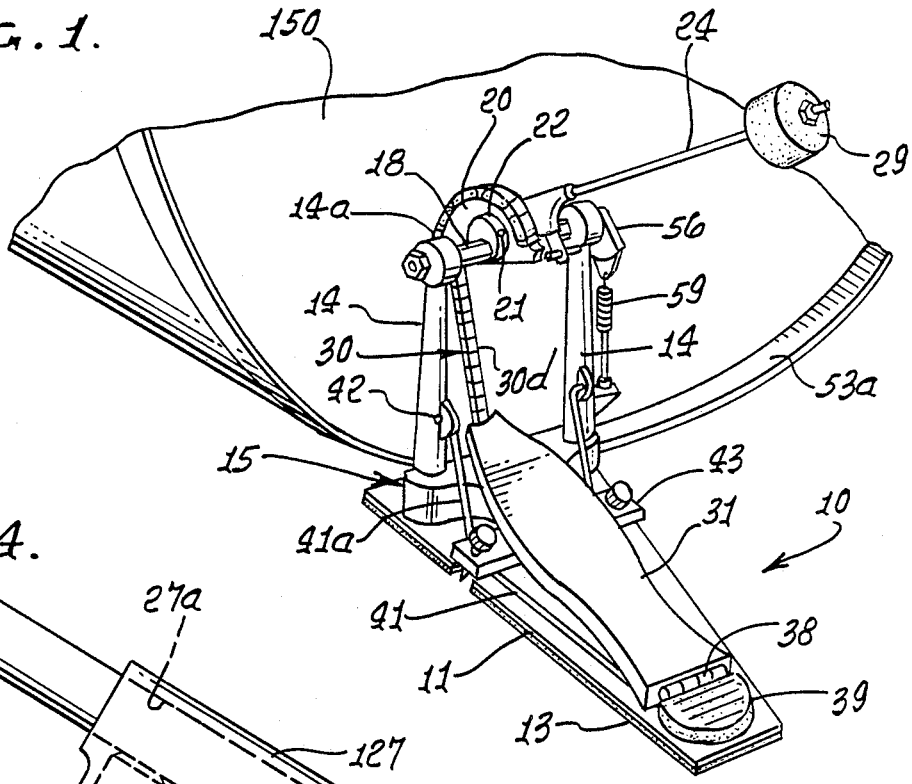
FIG. 1 is a perspective view of drum beating apparatus incorporating the invention.

The foot-operated bass drum pedal assembly 10 illustrated includes forwardly longitudinally elongated, horizontal base plate 11 which is relatively heavy and metallic to anchor the device on a floor surface 12. In this regard, the plate may consist of steel, and typically carries an elastomer layer 13 such as rubber on its underside to grip the floor. The underside of layer 13 may be serrated to enhance the grip.

Mounted to the upper side of the plate is a sub-assembly that includes two upright laterally spaced pedestals 14 interconnected by a bottom yoke plate 15. These elements are also metallic, and may consist of steel. The yoke plate is attached to plate 11 by two threaded fasteners 16 and 17.

Figure 4:
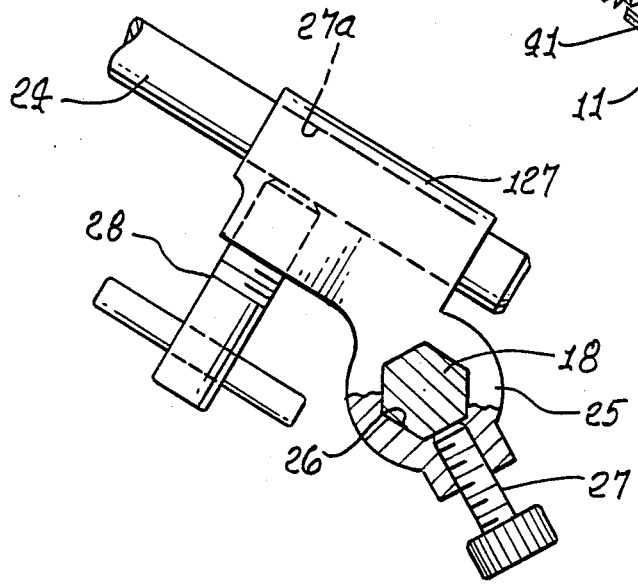
FIG. 4 is an enlarged fragmentary view showing drum stick connection to the shaft.

A horizontal shaft 18 extends laterally between, and is rotatably supported by the two pedestals, near their upper-most extent; to this end, suitable shaft bearings may be located in the pedestal enlarged end portions 14*a*. The shaft may be polygonal to mount a rotor such as a toothed sprocket 20, and the sprocket may have a corresponding polygonal bore to closely fit the shaft. A set screw 21 in sprocket hub 22 engages the shaft to position the sprocket on the shaft. The shaft also carries a drum stick or rod 24, via a hub 25 fitted on the shaft and shown in FIG. 4. The hub has a polygonal bore 26 to closely fit the shaft, in driven relation. A set screw 27 carried by the hub tightens against the shaft to locate the hub endwise thereon. A boss 127 integral with the hub has a bore 27*a* receiving the end of the shaft 24, and a set screw 28 carried by the boss 27 tightens against the shaft end to adjustably position the shaft end, endwise, on the boss. A beater head 29 is attached to the opposite and remote end of the shaft 24.

Figure 5:
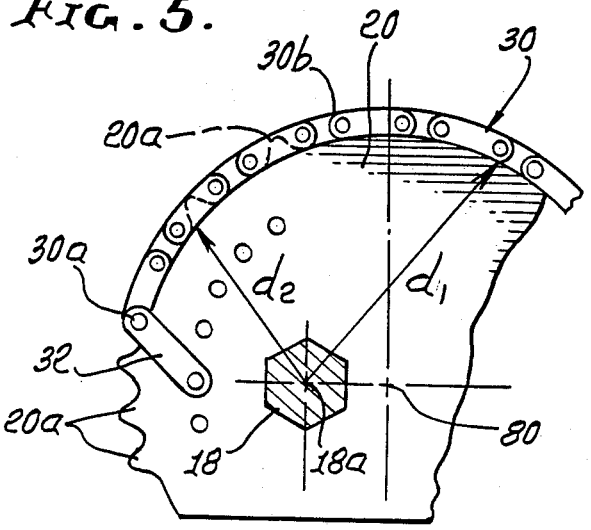
FIG. 5 is a fragmentary view showing sprocket and chain details.
Figure 6:
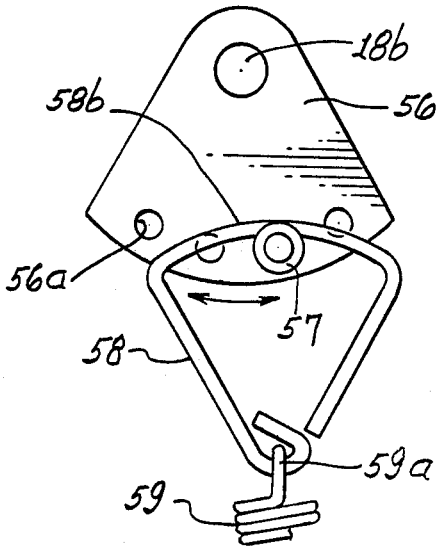
FIG. 6 is an enlarged view of spring attachment to the sprocket shaft.
Figure 2:
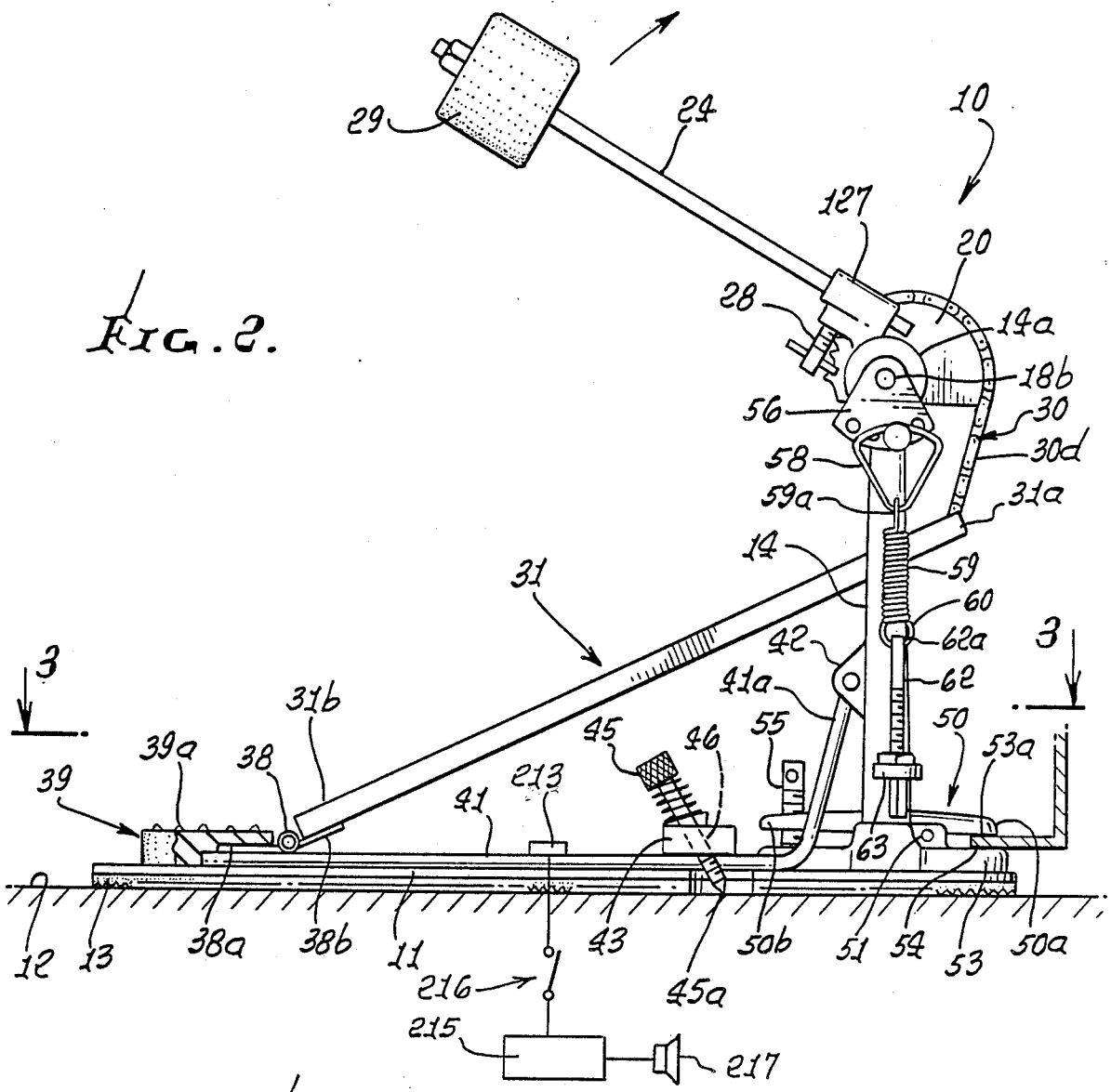
FIG. 2 is a side elevation showing the FIG. 1 apparatus.
Figure 3:
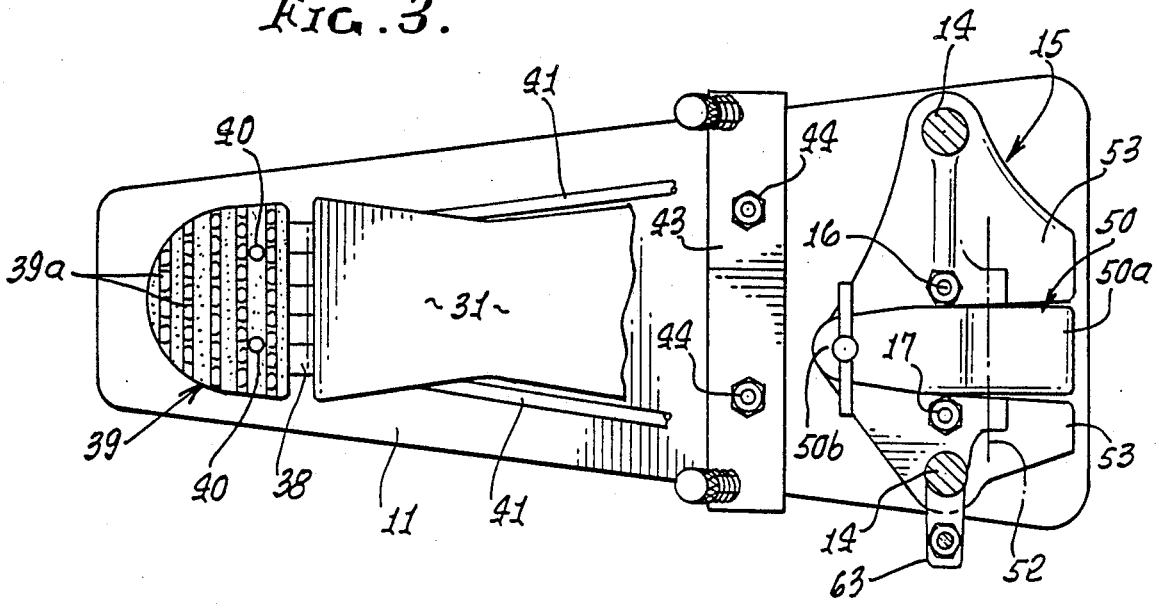
FIG. 3 is a top plan view taken on lines 3—3 of FIG. 2.

Flexible chain 30 is entrained on the sprocket teeth, and has opposite end portions, one of which is anchored to the sprocket at 30*a*, spaced above the base plate and above a pedal 31. FIG. 5 shows a chain anchor link 32 attached as by a fastener to the sprocket, and spaced about the sprocket and shaft axis of rotation. This enables adjustment of pedal angle of inclination relative to the base plate, as will appear. The forwardly elongated pedal extends in inclined relation above the base plate, and has a forward portion 31*a* of the pedal attached to the lower end of the chain dependent below the forwardmost extent of the sprocket, to be displaced downwardly as the pedal is pressed downwardly, thereby rotating the sprocket, shaft, and beater, to beat the bass drum 150.

It will be noted that the axis 18*a* of rotation of the sprocket and axle shaft 18 are eccentric relative to the sprocket teeth 20*a* engaged by the chain. In particular, the chain has a mid-portion 30*b* meshing with the teeth, and being at progressively increasing distance (compare large distance $d_1$ with lesser distance $d_2$, for example, in FIG. 5) from the axis 18*a*, along the chain length in a direction toward the dangling portion 30*d* below the sprocket. As a result, the pedal accelerates faster the travel of the beater toward the drum, as during initial rotation of the sprocket by the chain, due to the longer torque arms, of which $d_2$ is representative, relative to the shorter torque arms (as at $d_1$) which are in effect as the sprocket completes its rotation and as the beater closely approaches the drum. This also enables more accurate timing of drum beating. Also, the cam effect serves to move forwardly the chain extent hanging below the sprocket, as the chain returns to the sprocket, thereby bringing the pedal up faster than if the sprocket rotated about its true center. The teeth are typically on a circle whose center is at 80 forward of axis 18*a*.

The pedal has a rear end portion 31*b* pivotally connected to the base plate near the rearward end thereof. Of unusual advantage for this purpose is a piano hinge 38 which extends transversely between the pedal rearwardmost extent and a heel pad 39. The hinge has two leaves, 38*a* and 38*b*. Leaf 38*a* projects rearwardly into the hard rubber heel pad to be anchored thereby, and the other leaf 38*b* is attached to the pedal rearwardmost extent, at the underside thereof. The heel pad is attached to the base plate, as by fasteners 40, and the threaded upper surface 39*a* of that pad is slightly higher in elevation than the top of the hinge 38.

Two support struts 41 typically in the form of steel rods, extend forwardly from the heel pad 39, in which they are embedded. The struts extend along the upper surface of the base plate, and then upwardly at 41*a* at a forward angle to connect to the two pedestals, at 42, for bracing same. A cross-piece 43 extends over the struts and is attached as by fasteners 44 to the base plate, thereby removably clamping the rods to the base plate, forwardly of heel pad 39. Bolts 45 are threadably attached at 46 to the cross-piece, and have tapered lower ends 45*a* that extend downwardly and forwardly at opposite lateral sides of the base plate, to adjustably penetrate or grip a floor surface for blocking forward bodily displacement of the base plate, in use.

A clamp finger 50 is rotatably carried by the yoke, as at lateral pivot locations 51, to pivot axis 52. The yoke also has two tongues 53 that extend forwardly beneath the level of the clamp finger, and at laterally opposite sides thereof, the tongues supported by the base plate. In use, the tongues support the downwardly convex lower side of the base drum rim 53*a* as at locations 54. The upper side of the rim is downwardly clamped by the forward portion 50*a* of the finger 50. Downward pivoting of the finger forward portion is adjustably effected by a set screw 55 threaded through the rearward extent 50*b* of the clamp finger, and bearing against the yoke plate, rearward of axis 52.

Shaft 18 has an end portion 18*b* that projects through one of the pedestals and to which a crank 56 is attached. The crank has a series of adjustment holes 56*a* therein, and spaced about the shaft axis. A cam pin 57 is selectively positioned in one of such holes, and a lost motion connector 58 rides on the pin. An upright return spring 59 has its upper end attached to connector 58 at 59*a*, and its lower end adjustably attached to one pedestal at 60.

The lost motion connector has a cam portion 58*b* which is downwardly concave and free to travel generally forwardly and rearwardly relative to pin 57 in an arc defined by the connector, as the shaft is rotated by the foot operated pedal, and as the crank is turned about the shaft axis to elevate and lower the connector, tensioning and relieving the beater return spring. A threaded connector 62 attached to the lower end of the spring at 62*a* is rotatable in a threaded opening in a lug 63 on the pedestal, to adjust the spring tension. During this adjustment, the connector 58 may be lifted off the pin 57, to allow rotation of the connector 62, for spring tension adjustment. Thus, a sturdy, compact, reliable and more accurate pedal unit is provided.

Figure 7:
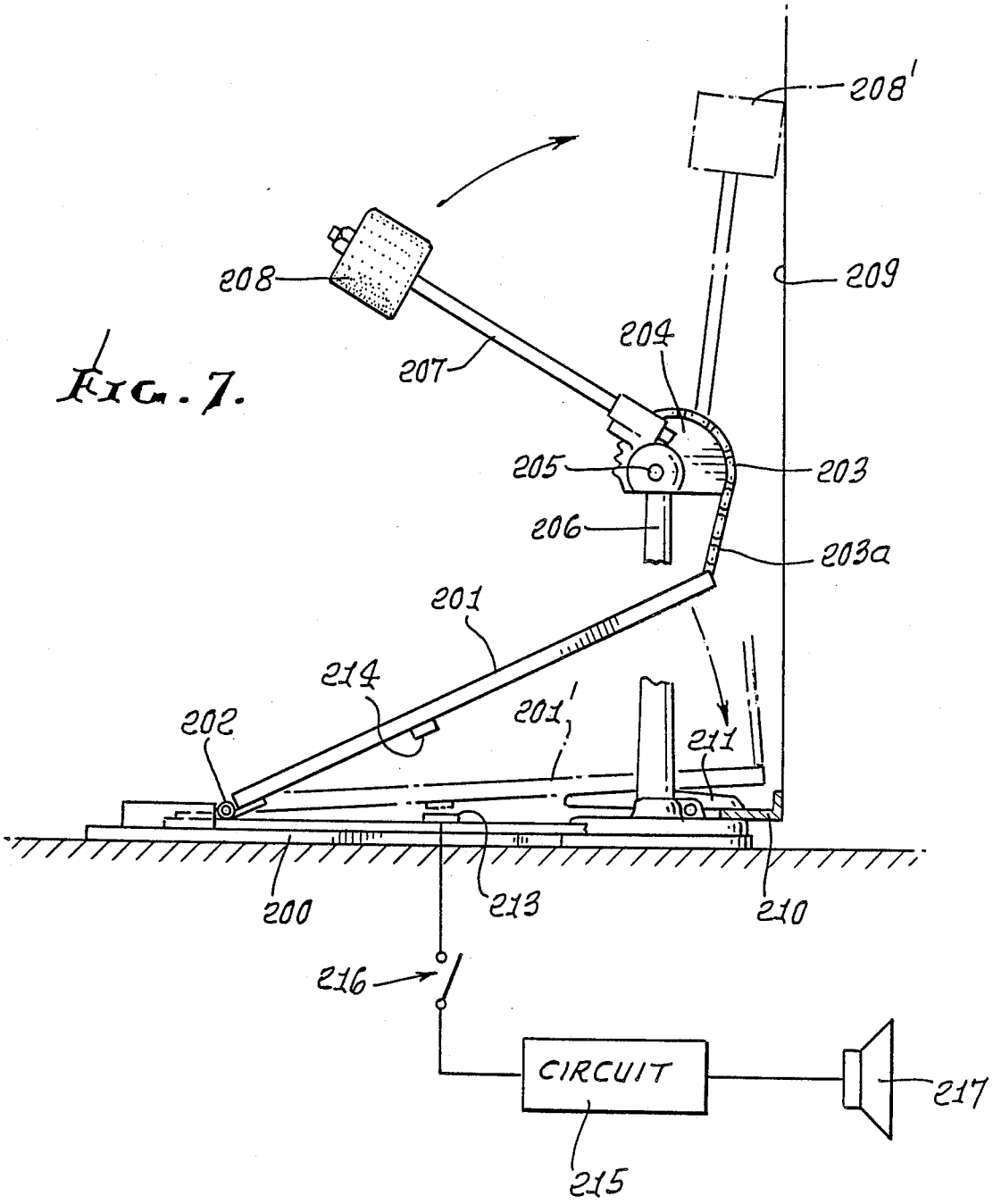
FIG. 7 is a schematic view.

Referring now to FIG. 7, it shows a base plate 200, pedal 201 hinged to the plate at 202, chain 203 having a dangling end portion 203*a* connected to the forward end of the pedal, and sprocket 204 having teeth entraining the chain. The detailed construction may be the same as in FIGS. 1–6. A horizontal axle 205 carries the sprocket, and is in turn carried by the pedestal 206. A drum beater includes a shaft 207 attached to the axle, and a head 208 that strikes the drum 209 in forward pivotal position, indicated at 208'. At that time, the pedal is pushed down to position 201'. Base plate 200 may be clamped to the bass drum rim 210, to position the drum and plate related to one another, such a clamp indicated at 211.

As referred to above, means is provided and located proximate the pedal to sense downward movement of the pedal to predetermined downward position, and to produce an electrical signal usable to effect production of phenomena corresponding to a drum beat.

Such means includes a first element 213 carried by the plate 200, at or proximate the top of the plate, and a second element 214 carried by the pedal 201, at or proximate the underside of the pedal. One of the elements, such as 213, is characterized as sensing the proximity of the other element, such as 214, to produce the electrical signal when the pedal arrives at downward position 201'. Element 214 is typically a permanent magnet, and element 213 is typically a Hall Effect Device (HED) or sensor.

Circuitry 215 is shown as connected via switch 216 with the device 213 to produce the phenomena, as for example sound via speaker 217, i.e. a drum beat synchronized with the beat of the drum when struck by the head 208. The synthesized sound from speaker 217 is advantageously initiated a fraction of a second prior to the initiation of the drum beat from drum 209.

As stated above, using a proximity detector to sense the position of the bass drum pedal provides a reliable trigger source that is physically independent of the bass drum, eliminating all false triggering from external sources and undesirable drum characteristics. The speed of the pedal when operating provides information to a proximity sensor that can be converted into signal that is proportional to the loudness of the note played. the position of the pedal can be used to gate the signal when the beater strikes the drum head. Both magnitude and timing of the resulting output signal can be easily user adjusted to compensate for mechanical dissimilarities between bass drums of different manufacture and electronic variations between different drum synthesizer designs. The use of a proximity detector is applicable to any pedal device used in drum synthesizer applications (e.g. a hi-hat pedal).

Figure 8:
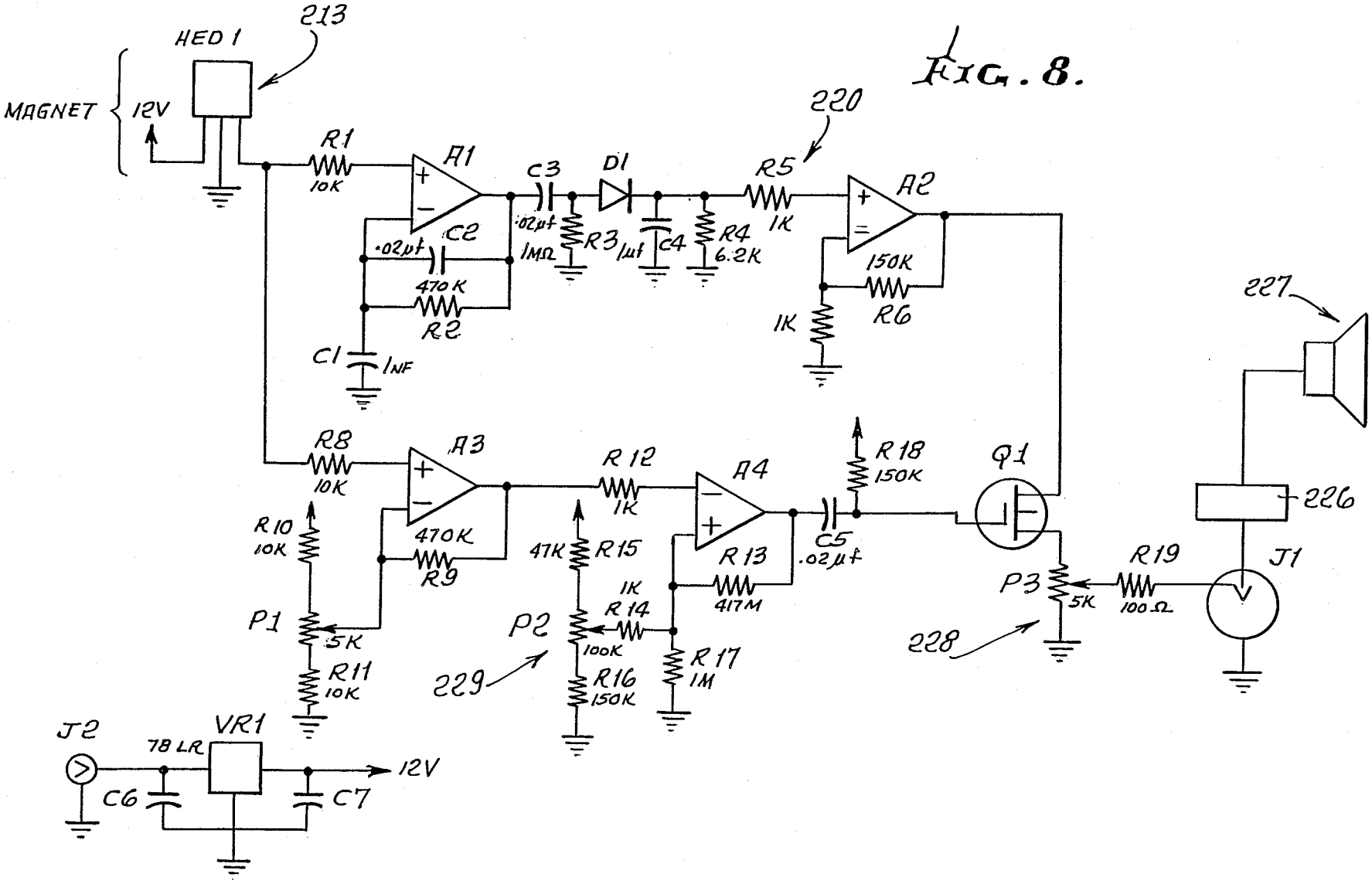
FIG. 8 is a circuit diagram.

Referring also to FIG. 8, showing detached circuitry, the Hall Effect device voltage output is passed to a differentiator circuit 220 whose output voltage is proportional to the time derivative of the rate of change of the HED voltage. The faster the pedal travels, the higher the output of the differentiator circuit.

The magnet 214 may be any magnet of moderate strength, for example measuring 1 square inch and having the north seeking pole facing the circuit. HED1 is a monolithic hall effect sensor 213. R1 through R9 are resistors. C1 through C7 are capacitors. D1 is a diode. Al through A4 are operational amplifiers. P1 through P3 are potentiometers. Q1 is the field effect transistor. VR1 is an integrated voltage regulator. J1 and J2 are connectors. Representation values are shown, but the circuit values may vary.

Using the HED 213 as the basis for a velocity sensitive drum pedal, the device and supporting electronics should be mounted in a suitable non-ferrous enclosure on a base plate under the foot pedal as far from the hinge mechanism as possible. For the best fit under the foot pedal, it is desirable to make the enclosure triangular in shape. A magnet measuring 1 to 1.5 square inches with moderate field strength is mounted to the underside of the foot pedal at a location that is directly over the HED when the pedal is fully depressed. Power for the circuit is supplied from a 12 volt DC wall transformer power supply. A phone jack is used to connect the output of the circuit to drum synthesizer 226. A potentiometer 228 is used to adjust the output level. Another potentiometer 229 is used to adjust output "on" time to coincide with the moment that the beater strikes the drum head.

I claim:

1. In drum beating apparatus, the combination comprising:

(a) a bottom, horizontally extending support plate, (b) upright structure attached to and supported by the plate, (c) a horizontal axle supported by said structure for rotation about a horizontal axis, (d) a sprocket carried by the axle at a support location, the sprocket having peripheral chain engaging teeth, and a chain meshing with said teeth, an end portion of the chain anchored to the sprocket, the chain having a dangling portion extending below the sprocket, (e) a pedal having a rear portion hingedly supported by the plate and a front portion attached to said dangling portion of the chain, (f) and means located proximate the pedal to sense downward movement of the pedal to predetermined downward position, and to produce an electrical signal usable to effect production of phenomena corresponding to a drum beat.

2. The apparatus of claim 1 including a drum beater attached to the axle to be rotated thereby and to strike a drum in synchronized relation to operation of said means to produce said signal.

3. The apparatus of claim 2 including a drum positioned forwardly of the plate to be struck by the beater just after production of said signal.

4. The apparatus of claim 1 wherein said means includes (i) first element carried by the plate, and (ii) a second element carried by the pedal, one of said elements characterized as sensing the proximity of the other element to produce the signal when the pedal arrives at said downward position.

5. The apparatus of claim 4 wherein at least one of the elements is a magnet.

6. The apparatus of claim 5 wherein the magnet element is carried by the pedal, and the other element is a Hall Effect Device.

7. The apparatus of claim 6 wherein said means includes circuitry connected to said Hall Effect Device to produce said phenomena.

8. The apparatus of claim 7 wherein said circuitry includes a differentiator sub-circuit whose output voltage is proportional to the time derivative of the rate of change of the Hall Effect Device voltage, whereby the faster the pedal travels, the higher the output of the differentiator sub-circuit, there being a gate element which passes the sub-circuit output voltage to a synthesizer circuit when gated "on" by a comparator, the comparator toggled in response to the Hall Effect Device output voltage reaches a predetermined level.

9. The apparatus of claim 1 wherein the chain has a mid-portion meshing with said teeth, and being at increasing distances from said axis along chain lengths in a direction toward said chain dangling portion.

10. In a foot-operated, base drum pedal assembly, the combination comprising:

(a) a forwardly elongated, horizontally extending base plate, (b) a sub-assembly including two upright pedestals and a yoke, the yoke attached to the base plate, (c) an axle shaft extending between and rotatably supported by the two pedestals, and defining an axis, (d) a drum stick carried by said axle shaft to be rotated thereby, to beat a drum, (e) a toothed sprocket mounted on the shaft to rotate same, about said axis, (f) a chain entrained on the sprocket teeth and having opposite end portions one of which is anchored to the sprocket, above the base plate, the chain extending at increasing distance from the axis along the chain length away from anchored end portion, and (g) a pedal extending in inclined relation to and above the base plate, the pedal having a rear end portion pivotally connected to the base plate near the rearward end thereof, the pedal having a forward end portion attached to the other end portion of the chain, below the level of the sprocket, and above a forward end portion of the base plate.

(h) and means located proximate the pedal to sense downward movement of the pedal to predetermined downward position, and to produce an electrical signal usable to effect production of phenomena corresponding to a drum beat.

11. The combination of claim 10 including a clamp finger carried by said yoke and attachable to a bass drum rim that overhangs the forwardmost extent of the base plate.

12. The combination of claim 11 wherein the clamp finger is rotatably carried by the yoke, the yoke having two forwardly extending tongues beneath the level of said clamp finger, and supported by the base plate forwardmost extent, said tongues adapted to support the lower side of the bass drum rim, the upper side of which is clamped by said finger.

13. The combination of claim 10 including an elastomer layer attached to the underside of said base plate, which is metallic, said means including a Hall Effect Device located at the upper side of the plate.

14. In a drum beating assembly the combination comprising:

(a) a base in the form of a metal plate, a first drum beater, a support for the beater mounted on the base, and a pedal pivotally mounted to the base and operatively connected to the beater to pivot same as the pedal is pivoted by the drummer's foot, (b) and means located beneath and proximate the pedal to sense downward movement of the pedal to predetermined downward position, and to produce an electrical signal usable to effect production of phenomena corresponding to a drum beat, (c) said beater support including upright structure on the plate, an axle carried by said structure, the beater mounted on the axle, there being a rotor on the axle and a flexible member connecting the rotor to the forward extent of the petal.

15. The assembly of claim 14 including a drum positioned forwardly of the plate to be struck by the beater just after production of said signal.

16. The assembly of claim 14 wherein said means includes (i) first element carried by the plate, and (ii) a second element carried by the pedal, one of said elements characterized as sensing the proximity of the other element to produce the signal when the pedal arrives at said downward position.

17. The assembly of claim 16 wherein the second element is a magnet element carried by the pedal, and the other element is a Hall Effect Device.

18. The assembly of claim 17 wherein said means includes circuitry connected to said Hall Effect Device to produce said phenomena.

19. The assembly of claim 17 wherein the magnet element is carried at the underside of the pedal, and the Hall Effect Device is carried at the upper side of the plate.

* * * * *